US008348710B2

(12) United States Patent
Cai et al.

(10) Patent No.: US 8,348,710 B2
(45) Date of Patent: Jan. 8, 2013

(54) METHOD FOR MAKING CATHODE SLURRY

(75) Inventors: Qi Cai, Beijing (CN); Tong-Feng Gao, Beijing (CN); Jie Tang, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/941,158

(22) Filed: Nov. 8, 2010

(65) Prior Publication Data

US 2011/0244754 A1 Oct. 6, 2011

(30) Foreign Application Priority Data

Mar. 31, 2010 (CN) ..... 2010 1 0137101

(51) Int. Cl.
*H01J 9/00* (2006.01)

(52) U.S. Cl. ..... 445/51

(58) Field of Classification Search ..... 313/495–497; 445/49–51

See application file for complete search history.

(56) References Cited

U.S. PATENT DOCUMENTS

| | | | | |
|---|---|---|---|---|
| 5,676,905 | A * | 10/1997 | Andersen et al. | 264/426 |
| 5,766,525 | A * | 6/1998 | Andersen et al. | 264/40.1 |
| 6,402,951 | B1 * | 6/2002 | Wilson et al. | 210/500.25 |
| 6,428,841 | B1 * | 8/2002 | Iijima et al. | 427/77 |
| 6,495,258 | B1 * | 12/2002 | Chen et al. | 428/408 |
| 7,572,165 | B2 * | 8/2009 | Liu et al. | 445/51 |
| 2003/0118905 | A1 * | 6/2003 | Fukuoka et al. | 429/218.1 |
| 2005/0186104 | A1 * | 8/2005 | Kear et al. | 419/11 |
| 2005/0189860 | A1 * | 9/2005 | Nam et al. | 313/311 |
| 2005/0236951 | A1 * | 10/2005 | Liu et al. | 313/310 |
| 2007/0092787 | A1 * | 4/2007 | Wang Chen | 429/45 |
| 2008/0252195 | A1 | 10/2008 | Liu et al. | |
| 2008/0279710 | A1 * | 11/2008 | Zhamu et al. | 419/6 |
| 2009/0021143 | A1 * | 1/2009 | Kim et al. | 313/503 |
| 2009/0124160 | A1 * | 5/2009 | Xu | 445/51 |
| 2009/0284122 | A1 | 11/2009 | Yang et al. | |

FOREIGN PATENT DOCUMENTS

| | | |
|---|---|---|
| CN | 1684216 | 11/2005 |
| CN | 101285960 | 10/2008 |
| WO | WO2009143094 | 11/2009 |

* cited by examiner

*Primary Examiner* — Joseph L Williams
(74) *Attorney, Agent, or Firm* — Altis Law Group, Inc.

(57) ABSTRACT

A method for making cathode slurry is provided and includes the following steps. First, a plurality of electron emitters, an inorganic binder, and an organic carrier are provided. Second, the plurality of electron emitters, the inorganic binder, and the organic carrier are mixed to obtain a mixture. Third, the mixture is mechanically pressed and sheared.

19 Claims, 6 Drawing Sheets

METHOD FOR MAKING CATHODE SLURRY

CROSS-REFERENCE TO RELATED APPLICATIONS

This application claims all benefits accruing under 35 U.S.C. §119 from China Patent Application No. 201010137101.5, filed on Mar. 31, 2010 in the China Intellectual Property Office, the disclosure of which is incorporated herein by reference.

BACKGROUND

1. Technical Field

The present disclosure relates to a method for making cathode slurry.

2. Description of Related Art

A field emission cathode is an important element for a field emission device. A field emission cathode is usually made by printing a cathode slurry including a plurality of electron emitters on a cathode conductive layer and exposing the electron emitters from the cathode slurry.

Carbon nanotubes (CNT) are very small tube-shaped structures, and have extremely high electrical conductivity, very small diameters, and a tip-surface area near the theoretical limit. Thus, carbon nanotubes can transmit an extremely high electrical current and be used to make cathode slurry. The cathode slurry based on carbon nanotubes is usually made by dispersing carbon nanotubes in organic solvent by ultrasonic vibrating to form a first mixture, dispersing indium tin oxide (ITO) particles and glass powder in organic solvent by ultrasonic vibrating to form a second mixture, mixing the first mixture and the second mixture with an organic carrier to form a third mixture, and vaporizing the third mixture to remove the organic solvent to obtain cathode slurry based on carbon nanotubes. However, the viscosity and plasticity of the cathode slurry is difficult to control because the vaporizing time and temperature should be controlled accurately according to the weight percentage of the ingredient. If the vaporizing time is too long and the temperature is too high, the viscosity of the carbon nanotube cathode slurry will be too high and the carbon nanotube cathode slurry will be less liquid. If the vaporizing time is too short and the temperature is too low, the carbon nanotube cathode slurry will be less plastic.

What is needed, therefore, is to provide a method for making a cathode slurry that can overcome the above-described shortcomings.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
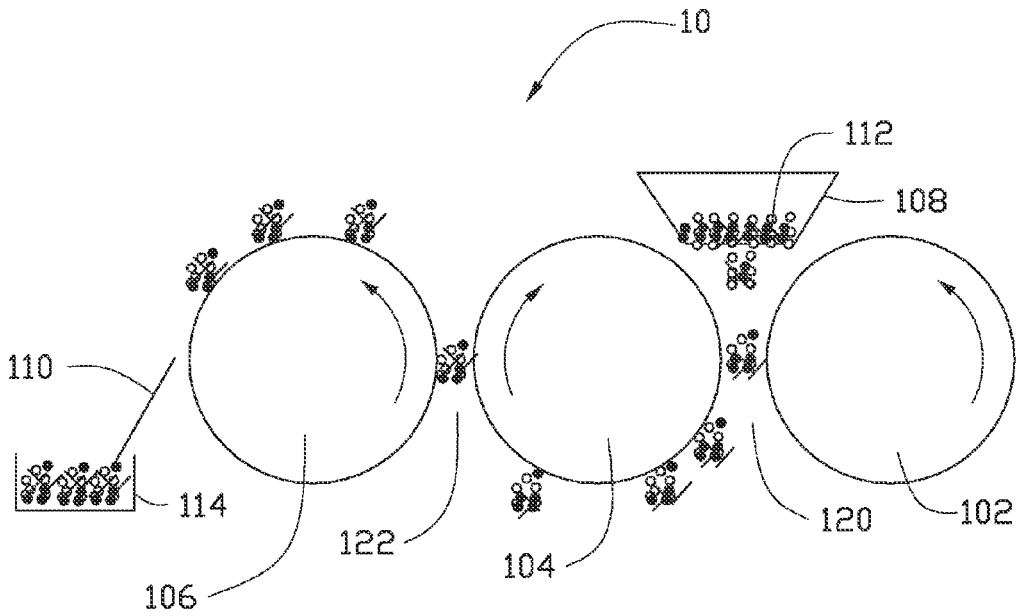
FIG. 1 is a three-roll roller mill in a method for making cathode slurry of one embodiment.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present method for making cathode slurry.

A method for making cathode slurry of one embodiment includes the following steps of:

step (a), providing a plurality of electron emitters, an inorganic binder, and an organic carrier;

step (b), mixing the plurality of electron emitters, the inorganic binder, and the organic carrier to obtain a mixture;

step (c), pressing and shearing the mixture mechanically to allow the mixture to be uniform.

In step (a), the electron emitters can be carbon nanotubes, carbon nano-fibres, metal nano-wires, metal nano-straps, semiconductor nano-wires, or semiconductor nano-straps. In one embodiment, the electron emitters are carbon nanotubes. The carbon nanotubes can be single-walled carbon nanotubes, double-walled carbon nanotubes, multi-walled carbon nanotubes, and combinations thereof. The diameter of each single-walled carbon nanotube can range from about 0.5 nanometers to about 50 nanometers. The diameter of each double-walled carbon nanotube can range from about 1 nanometer to about 50 nanometers. The diameter of each multi-walled carbon nanotube can range from about 1.5 nanometers to about 50 nanometers. The length of the carbon nanotubes can be larger than 1 micrometer. In one embodiment, the length of the carbon nanotubes is in a range from about 5 micrometers to about 15 micrometers.

The inorganic binder can be glass powder, silicon dioxide ($SiO_2$) powder, or tin oxide ($SnO_2$) powder. In one embodiment, the inorganic binder is glass powder. The glass powder can be a low melting point glass powder with a melting point in a range from about 300° C. to about 600° C. The effective diameter of the glass powder can be less than or equal to 10 micrometers. In one embodiment, the effective diameter of the glass powder is less than or equal to 1 micrometer.

The organic carrier is a volatilizable organic material and can be removed by heating. The organic carrier can include a diluent, stabilizer, and plasticizer. The diluent can dissolve the stabilizer and allows the carbon nanotube cathode slurry to have liquidity. The diluent can be terpineol. The stabilizer has strong polarity and can combine with the plasticizer to form a network structure or chain structure to enhance the viscosity and plasticity of the carbon nanotube cathode slurry. The stabilizer can be a polymer such as ethyl cellulose. The plasticizer is solvent with a molecular chain having strong polarized groups, and can combine with the stabilizer to form a network structure. The plasticizer can be dibutyl phthalate or dibutyl sebacate. In one embodiment, the plasticizer is dibutyl sebacate with a boiling point of about 344° C. The dibutyl sebacate is very volatilizable and inexpensive. The dibutyl sebacate does not contain a benzene ring and is environmentally safe. Furthermore, the organic carrier can include surfactant, such as Span 40 with a formula of $C_6H_8O$ $(OH)_3OCO(CH_2)_{14}CH_3$ $C_{22}H_{42}O_6$ or Span 60 with a formula of $C_6H_8O(OH)_3OCO(CH_2)_{16}CH_3$ $C_{24}H_{46}O_6$.

In one embodiment, the electron emitters are multi-walled carbon nanotubes with a diameter less than or equal to 10 nanometers and a length in a range from about 5 micrometers to about 15 micrometers. The inorganic binder is a low melting point glass powder with an effective diameter less than or equal to 10 micrometers. The organic carrier includes terpineol, ethyl cellulose, dibutyl sebacate, and Span 40. The weight ratio of the terpineol, ethyl cellulose, dibutyl sebacate, and Span 40 is 180:11:10:2.

In step (b), the electron emitters, the inorganic binder, and the organic carrier are applied into a container and agitated mechanically to form the mixture. The agitating time can range from about 10 minutes to about 30 minutes.

In one embodiment, the multi-walled carbon nanotubes, the low melting point glass powder and the organic carrier are mixed to form a mixture. The weight percentage of the carbon nanotubes in the carbon nanotube cathode slurry can range from about 2% to about 5%. The weight percentage of the glass powder in the carbon nanotube cathode slurry can range from about 2% to about 5%. The weight percentage of the organic carrier in the carbon nanotube cathode slurry can range from about 90% to about 96%. If the total weight percentage of the carbon nanotubes and glass powder in the carbon nanotube cathode slurry is too high, the viscosity of the carbon nanotube cathode slurry will be too high. The carbon nanotube cathode slurry would adhere easily to the screen in a screen printing process and cause edges of a printed carbon nanotube cathode slurry pattern to be irregular. If the total weight percentage of the carbon nanotubes and glass powder in the carbon nanotube cathode slurry is too small, the carbon nanotube cathode slurry will be less plastic. The carbon nanotube cathode slurry would be difficult to mold in the screen printing process and a plurality of holes will be formed in the printed carbon nanotube cathode slurry pattern. Controlling the weight percentage of the carbon nanotubes in a range from about 2% to about 5% and the weight percentage of the glass powder in a range from about 2% to about 5%, the carbon nanotube cathode slurry can have proper viscosity and plasticity. Thus, the carbon nanotube cathode slurry can meet the requirements of screen printing.

In one embodiment, the weight percentage of the carbon nanotubes in the carbon nanotube cathode slurry can range from about 2.5% to about 3%. The weight percentage of the glass powder in the carbon nanotube cathode slurry can range from about 2.5% to about 3%. The weight percentage of the organic carrier in the carbon nanotube cathode slurry can range from about 94% to about 95%. Four carbon nanotube cathode slurry samples are provided as shown in the following Table 1.

TABLE 1

Four Carbon Nanotube Cathode Slurry Samples

| Sample Number | Carbon Nanotubes (g) | Low Melting Point Glass Powder (g) | Organic Carrier (g) |
|---|---|---|---|
| A | 0.3 | 0.3 | 10 |
| B | 0.3 | 0.4 | 10 |
| C | 0.3 | 0.5 | 10 |
| D | 0.4 | 0.4 | 10 |

In step (c), the mixture can be pressed and sheared by a device such as a roller mill, a colloid mill, an emulsor, or a kneader. The pressing and shearing process makes the mixture uniform in a small area. The pressing and shearing process can be repeated several times to make the obtained cathode slurry uniform. The uniformity of the light intensity of a field emission display using the cathode slurry depends on the uniformity of the cathode slurry.

In one embodiment, a three-roll roller mill 10 is used to press and shear the mixture. The three-roll roller mill 10 includes a first roller 102, a second roller 104, a third roller 106, an input device 108, an output device 110, and an electromotor (not shown). The first roller 102, the second roller 104, and the third roller 106 are arranged in order and substantially parallel to each other. An input gap 120 is defined between the first roller 102 and the second roller 104. An output gap 122 is defined between the second roller 104 and the third roller 106. The input device 108 is positioned above the input gap 120. The output device 110 is located adjacent to the third roller 106. In use, the first roller 102, the second roller 104, and the third roller 106 are rotated along a direction as shown in FIG. 1. The mixture 112 is input into the input gap 120, and is pressed and sheared by the first roller 102 and the second roller 104. The mixture 112 is pressed and sheared by the second roller 104 and the third roller 106, and enters a container 114 through the output device 110.

In one embodiment, step (c) includes the substeps of:

step (c1), measuring a particle size of the mixture 112;

step (c2), adjusting the input gap 120 and the output gap 122, so that the width of the input gap 120 is equal to the particle size of the mixture 112 and the width of the output gap 122 is in a range from about ¼ to about ½ of the width of the input gap 120;

step (c3), grinding the mixture 112 using the three-roll roller mill 10;

step (c4) repeating step (c1) to step (c3) until the particle size of the mixture does not decrease;

step (c5), adjusting the width of the input gap 120 and the width of the output gap 122 to a minimum, and grinding the mixture 112.

In step (c1), the particle size of the mixture can be measured by a Model QXD particle size analyzer. The particle size of the mixture 112 is the particle size of the electron emitters and the inorganic binder such as glass powder in the mixture 112.

In step (c2), the width of the output gap 122 is about ⅓ of the width of the input gap 120 in one embodiment.

In step (c3), the rotation speed of the first roller 102, the second roller 104, and the third roller 106 is in a range from about 150 rpm to about 250 rpm. In one embodiment, the rotation speed of the first roller 102, the second roller 104, and the third roller 106 is about 200 rpm.

In step (c4), step (c1) to step (c3) is repeated until the particle size of the mixture 112 is less than or equal to ⅓ of a diameter of a screen. The screen is a screen used to print the cathode slurry. In one embodiment, the diameter of the screen is about 45 micrometers, and the particle size of the mixture is less than or equal to 15 micrometers.

In step (c5), both the width of the input gap 120 and the width of the output gap 122 are about 5 micrometers. Step (c5) is repeated for about 3 times to about 7 times.

Furthermore, an optional step (d) of adding a plurality of conductive particles can be performed after step (b). The conductive particles can be indium tin oxide particles or metal particles. The metal particles can be gold particles, silver particles, aluminum particles, or copper particles. The effective diameters of the conductive particles can range from about 10 nanometers to about 10 micrometers. In one embodiment, the effective diameters of the conductive particles range from about 10 nanometers to about 100 nanometers.

Figure 2:
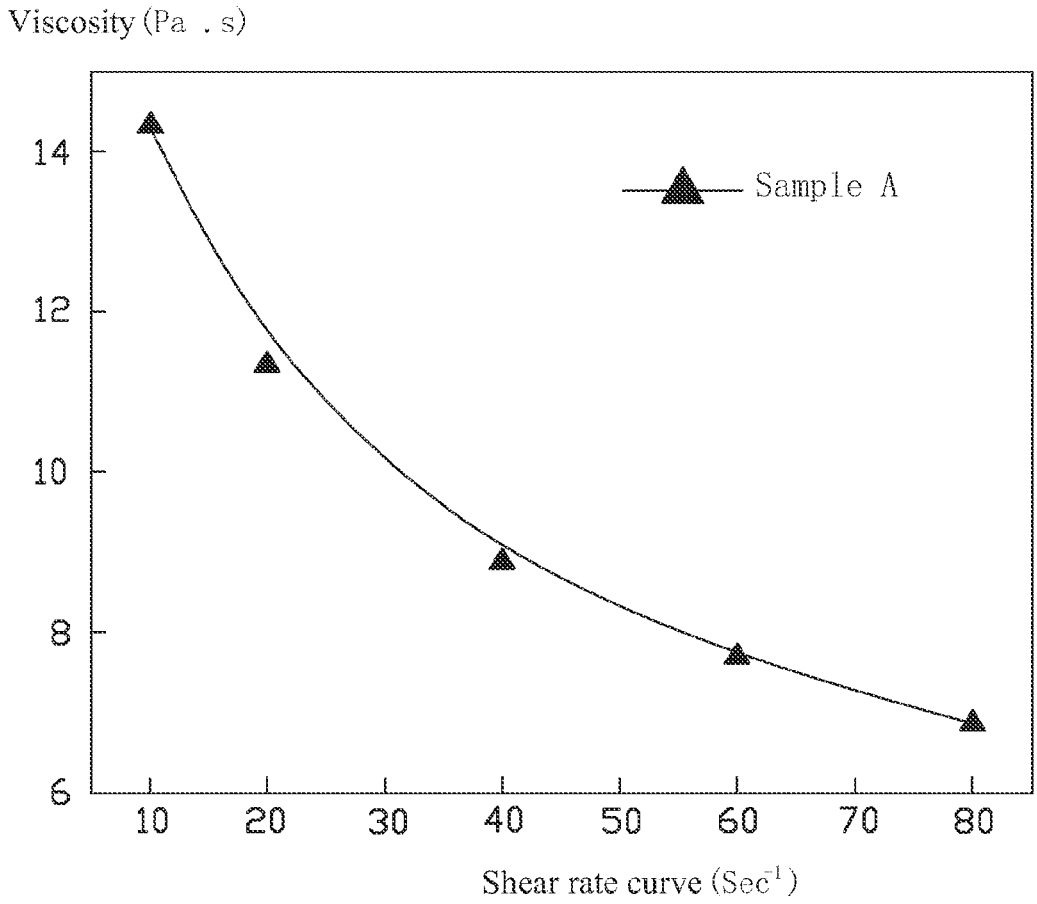
FIG. 2 is a viscosity vs. shear rate curve of a carbon nanotube cathode slurry of one embodiment.

The viscosities of the four carbon nanotube cathode slurry samples are tested. The viscosity of the carbon nanotube cathode slurry is in a range from about 13 Pa·s to about 16 Pa·s at a shear rate of about 10 second$^{-1}$. FIG. 2 shows a viscosity vs. shear rate curve of the carbon nanotube cathode slurry sample A. The viscosity of the carbon nanotube cathode slurry sample A decreases as the shear rate increases. Therefore, the carbon nanotube cathode slurry is a pseudo plastic fluid and very suitable for printing requirements.

In one embodiment, a field emission property of the sample B is tested. A field emission cathode is made by steps of:

step (x), depositing an aluminum film on a glass substrate to form a cathode conductive layer;

step (y), printing the cathode slurry sample B on the aluminum film to form a cathode emission layer; and step (z), exposing the carbon nanotubes from the cathode emission layer.

Figure 3:
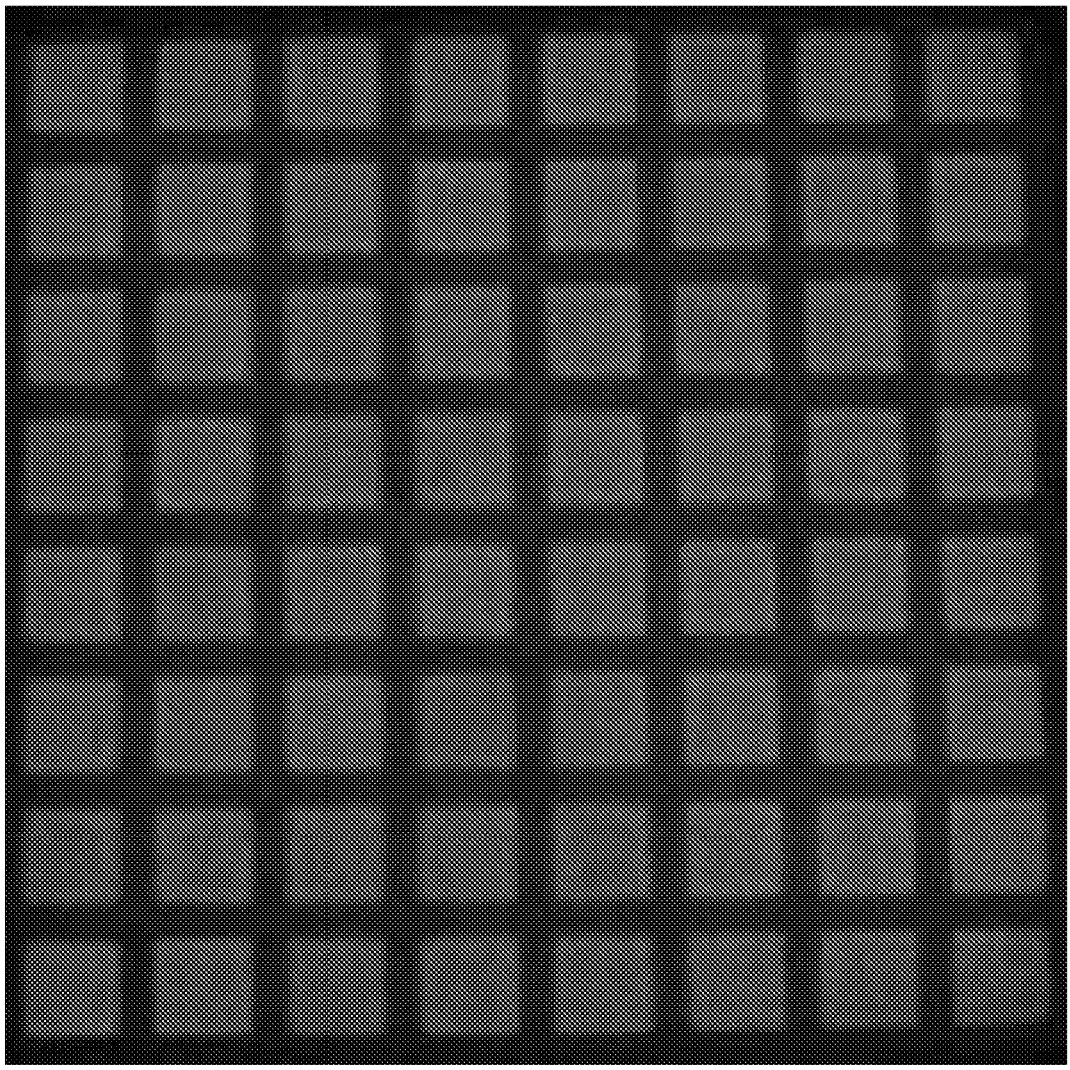
FIG. 3 shows an image of a field emission display of one embodiment at a low working voltage.
Figure 4:
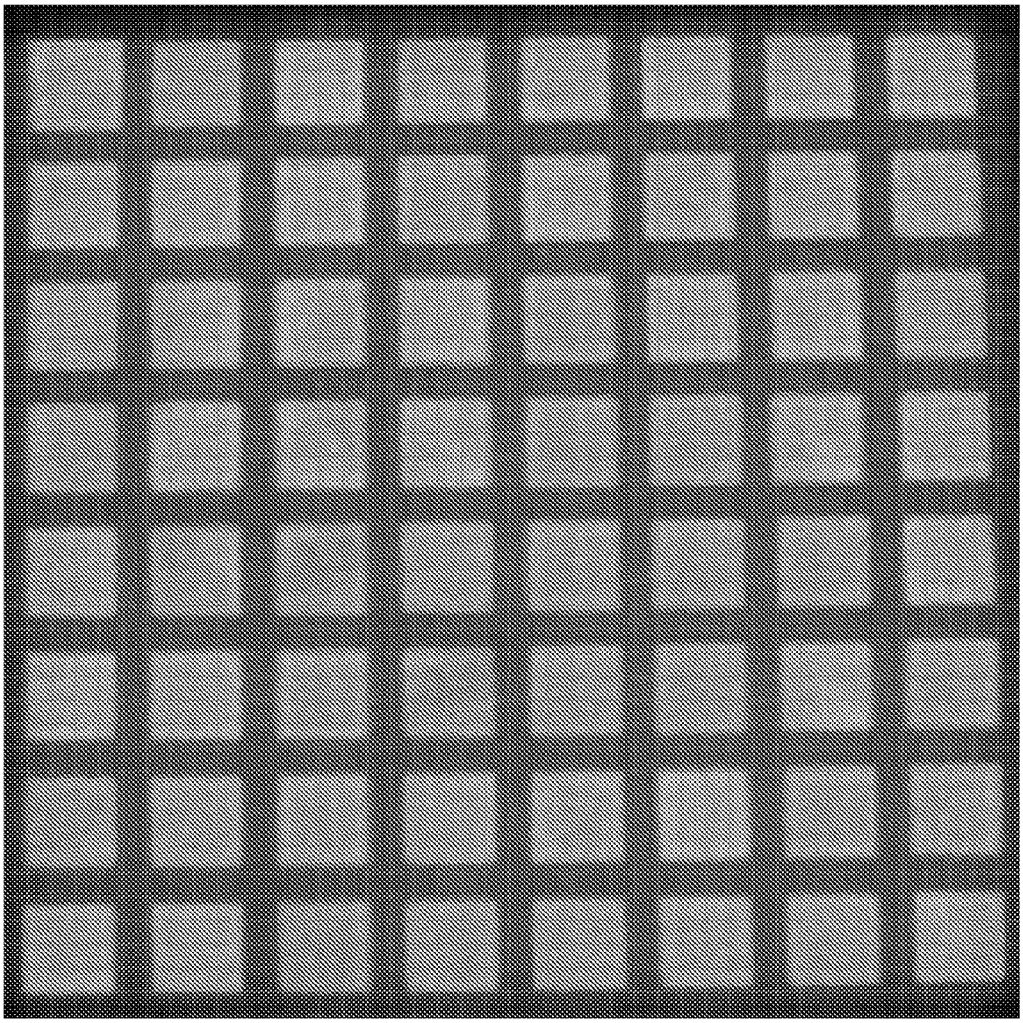
FIG. 4 shows an image of a field emission display of one embodiment at a high working voltage.
Figure 5:
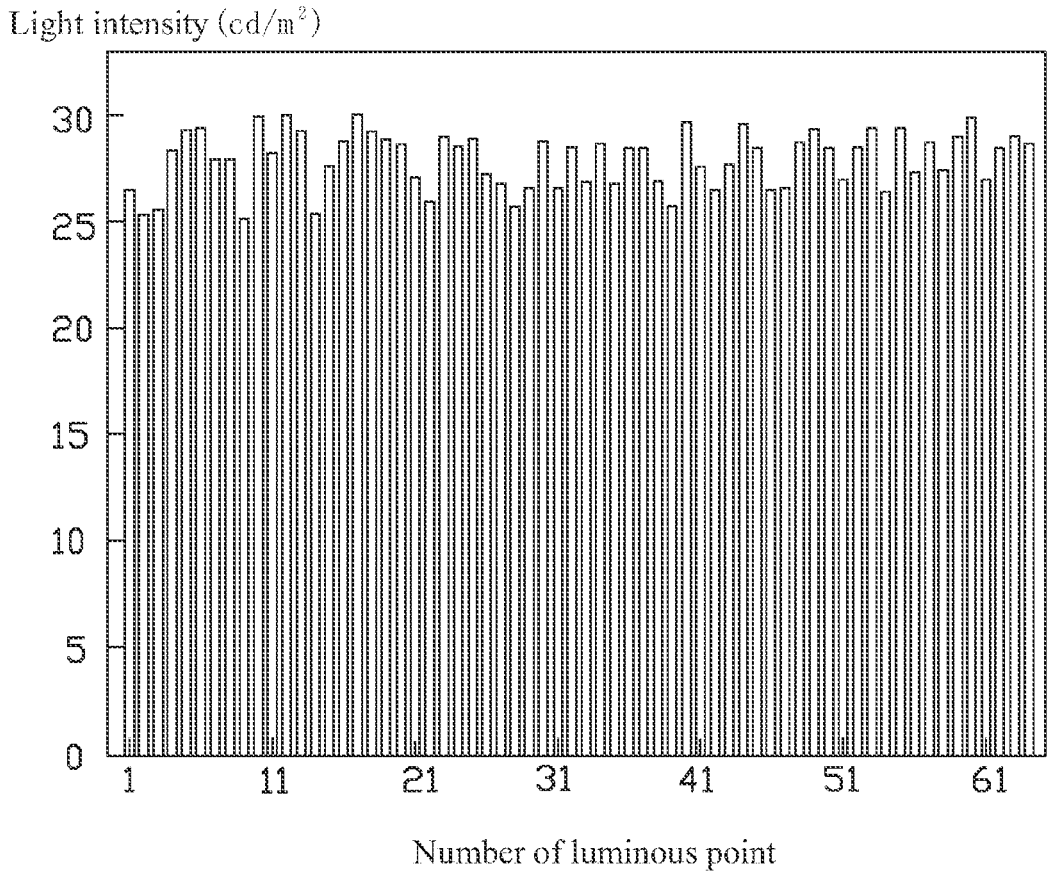
FIG. 5 shows light intensity of each luminous point of image of FIG. 3.
Figure 6:
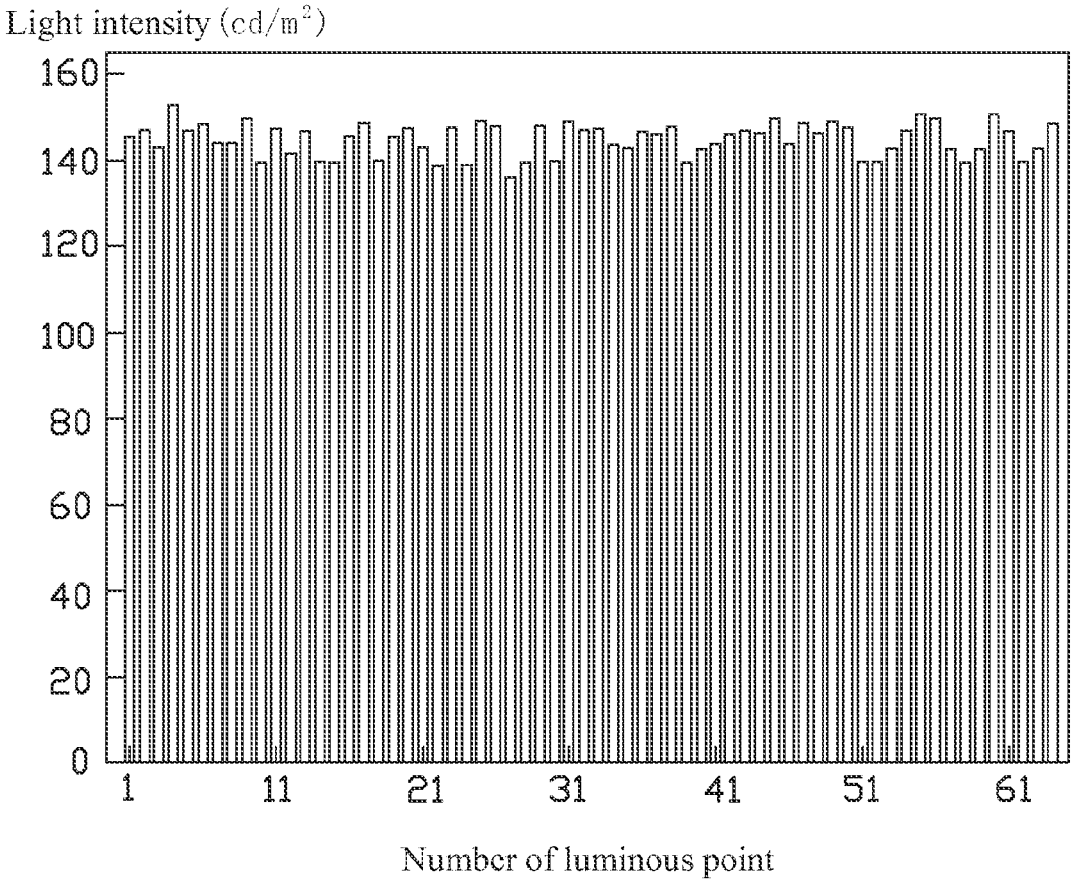
FIG. 6 shows light intensity of each luminous point of image of FIG. 4.

The cathode emission layer includes 8×8 (8 rows, 8 emission elements on each row) emission elements. Each emission element is a square with side length of about 5 millimeters. The field emission cathode is sealed in a vacuum to form a field emission display, wherein each emission element corresponds to one square fluorescent layer with a side length of about 5 millimeters to form a luminous point. The brightness of the field emission display is tested on a high voltage and a low voltage. The low voltage is about 3150V corresponding to a field emission current of about 2.5 mA/cm$^2$. The high voltage is about 4160V corresponding to a field emission current of about 10 mA/cm$^2$. As shown in FIGS. 3 and 4, the brightness of the field emission display is uniform and can meet the brightness requirements of large scale screen display. FIG. 5 shows the light intensity of each luminous point of FIG. 3. In FIG. 3, the light intensity average of 64 luminous points is about 27.93 cd/m$^2$, the light intensity maximum is about 30.01 cd/m$^2$, and the light intensity minimum is about 25.12 cd/m$^2$. FIG. 6 shows the light intensity of each luminous point of FIG. 4. In FIG. 4, the light intensity average of 64 luminous points is about 144.79 cd/m$^2$, the light intensity maximum is about 152.6 cd/m$^2$, and the light intensity minimum is about 136 cd/m$^2$. Therefore, the eyes cannot feel brightness discrimination.

The method for making cathode slurry has the following advantages. First, because the method omits the process of removing the organic solvent by vaporizing, the viscosity and plasticity of the cathode slurry dependency on the weight percentage of the ingredient is easy to control. Second, because the method does not use volatilizable organic solvents, the final cathode slurry product has no volatilizable organic solvent therein. Thus, the viscosity and plasticity of the final cathode slurry product is constant. Finally, because the method omits the process of removing the organic solvent, the cost is low and efficiency is high.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A method for making cathode slurry, the method comprising steps of:

step (a), providing a plurality of electron emitters, an inorganic binder, and an organic carrier, the electron emitters being carbon nanotubes, the inorganic binder being glass powder;

step (b), mixing the plurality of electron emitters, the inorganic binder, and the organic carrier to obtain a mixture; and step (c), pressing and shearing the mixture mechanically to obtain the cathode slurry, wherein a weight percentage of the carbon nanotubes in the cathode slurry ranges from about 2.5% to about 3%, a weight percentage of the glass powder in the cathode slurry ranges from about 2% to about 5%.

2. The method of claim 1, wherein the electron emitters are selected from the group consisting of carbon nanotubes, carbon nano-fibres, metal nano-wires, metal nano-straps, semiconductor nano-wires, and semiconductor nano-straps.

3. The method of claim 1, wherein the electron emitters are carbon nanotubes, and a length of each of the carbon nanotubes is in a range from about 5 micrometers to about 15 micrometers.

4. The method of claim 1, wherein the inorganic binder is selected from the group consisting of glass powder, silicon dioxide powder, and tin oxide powder.

5. The method of claim 1, wherein, the inorganic binder is a low melting point glass powder with a melting point in a range from about 300° C. to about 600° C.

6. The method of claim 1, wherein the organic carrier is a volatilizable organic material and comprises a diluent, a stabilizer, and a plasticizer.

7. The method of claim 1, wherein the organic carrier comprises terpineol, ethyl cellulose, and dibutyl phthalate.

8. The method of claim 1, wherein the organic carrier comprises terpineol, ethyl cellulose, and dibutyl sebacate.

9. The method of claim 8, wherein the organic carrier further comprises a surfactant;

a weight ratio of the terpineol, ethyl cellulose, dibutyl sebacate, and surfactant is about 180:11:10:2.

10. The method of claim 1, wherein in step (b), the electron emitters, the inorganic binder, and the organic carrier are applied into a container and agitated mechanically.

11. The method of claim 1, wherein in step (c), the mixture is pressed and sheared by a device selected from the group consisting of a roller mill, a colloid mill, an emulsor, and a kneader.

12. The method of claim 1, wherein in step (c), the mixture is pressed and sheared by a three-roll roller mill comprising a first roller, a second roller, a third roller, an input device, and an output device.

13. The method of claim 12, wherein step (c) comprises the substeps of:

step (c1), measuring a particle size of the mixture;

step (c2), adjusting an input gap and an output gap, so that a width of the input gap is equal to the particle size of the mixture and a width of the output gap is in a range from about ¼ to about ½ of the width of the input gap, wherein the input gap is defined between the first roller and the second roller, and the output gap is defined between the second roller and the third roller;

step (c3), grinding the mixture using the three-roll roller mill;

step (c4) repeating step (c1) to step (c3) until the particle size of the mixture does not decrease;

step (c5), adjusting the width of the input gap and the width of the output gap to a minimum, and grinding the mixture.

14. The method of claim 13, wherein in step (c2), the width of the output gap is about ⅓ of the width of the input gap.

15. The method of claim 13, wherein in step (c3), a rotation speed of the first roller, the second roller, and the third roller is in a range from about 150 rpm to about 250 rpm.

16. The method of claim 13, wherein in step (c5), both the width of the input gap and the width of the output gap are about 5 micrometers.

17. The method of claim 13, wherein step (c5) is repeated for about 3 times to about 7 times.

18. A method for making cathode slurry, the method comprising steps of:

step (a), providing a plurality of electron emitters, glass powder, and an organic carrier, the electron emitters being carbon nanotubes;

step (b), mixing the plurality of carbon nanotubes, the glass powder, and the organic carrier to obtain a mixture free of organic solvent, wherein a weight percentage of the carbon nanotubes in the mixture ranges from about 2.5% to about 3%;

step (c), measuring a particle size of the mixture;

step (d), pressing and shearing the mixture using a roller mill; and step (e), repeating step (c) to step (d).

19. The method of claim 18, wherein a weight percentage of the glass powder of the mixture ranges from about 2.5% to about 3%, and a weight percentage of the organic carrier of the mixture ranges from about 94% to about 95%.

* * * * *